United States Patent [19]

Patten

[11] 4,453,580

[45] Jun. 12, 1984

[54] WOOD SPLITTING DEVICE

[76] Inventor: Wayne J. Patten, 155 Austin La., Alamo, Calif. 94507

[21] Appl. No.: 382,469

[22] Filed: Jul. 14, 1982

[51] Int. Cl.[3] ..... B27L 7/00

[52] U.S. Cl. ..... 144/193 A; 144/366

[58] Field of Search ..... 144/3 K, 193 R, 193 A, 144/366

[56] References Cited

U.S. PATENT DOCUMENTS

| | | | |
|---|---|---|---|
| 3,862,651 | 1/1975 | Heikkinen | 144/193 A |
| 4,236,556 | 12/1980 | Smith | 144/193 A |
| 4,246,942 | 1/1981 | Malik | 144/193 R |
| 4,341,246 | 7/1982 | Salladay | 144/193 A |
| 4,374,532 | 2/1983 | Region | 144/193 R |

*Primary Examiner*—W. D. Bray

*Attorney, Agent, or Firm*—Bielen & Peterson

[57] ABSTRACT

A device for splitting wood utilizing a platform for supporting the wood. A wedge is fixed to the platform and has an edge portion which contacts the wood. A pusher forces the wood and wedge to contact and causes the splitting of the wood.

9 Claims, 4 Drawing Figures

WOOD SPLITTING DEVICE

BACKGROUND OF THE INVENTION

The present invention relates to a novel and useful device or apparatus for splitting wood, especially useful for splitting tree logs.

The manufacture of firewood requires the splitting or cutting of round-like logs along a straight cutting edge. This task may be performed manually with a sledge hammer and a wedge or with a variety of log splitting machines especially designed for this task.

Unfortunately, log splitting machines are very expensive and often do not provide the power necessary to split large logs. Moreover, log splitting machines require a high level of maintenance if a large number of logs are to be split.

A device which utilizes an existing machine for splitting wood would be a notable advance in the field of the manufacture of firewood.

SUMMARY OF THE INVENTION

In accordance with the present invention, a novel and useful device for splitting wood is provided. The device of the present invention utilizes the components found in a backhoe and alters the same for use in splitting logs. The device includes a platform which supports the wood or the log to be split. The platform may gain purchase from the ground surface or any other immovable body. A wedge is fixed to the platform and is intended for contacting the log to be split. The wedge may take a configuration in that it includes a single edge or the wedge may have a multiplicity of edges. For examle, a second wedge may be placed so that its leading edge is angularly disposed in relation to the edge of the first wedge. Also, the second edge of the second wedge may be recessed in relation to the first edge such that the log would contact the first edge of the first wedge before contacting the second wedge. This configuration would permit the splitting of a log into more than two pieces.

The device of the present invention may also include means for pushing the wood to contact with the wedge along the platform. Such means may include an arm having a proximal and distal end portion. The distal end portion would be intended for contacting the wood while the proximal end portion of the arm would be linked to mean for extending and contracting the arm. Such extension and contraction means may take the form of a hydraulic arm commonly found in a backhoe. In addition, the means for pushing the wood may further include a track located on the platform and a rotatable member which is located between the proximal and distal end portions of the extendible arm. The rotatable member would be movable in the track during the extension and contraction of the arm. Also, means for confining the rotatable member to the track may be provided and may take the form of a strap or bracket which is affixed to the arm and slidingly engages the platform. The rotatable member of the means for pushing the wood into contact with the wedge along the platform may take the form of a pair of wheels rotatably mounted to an axle. The arm would provide an eye for holding the axle during extension and retraction of the arm. In addition, the arm may further include a face which is connected to the arm and lies between the rotatable member and the wedge along the platform.

Where the arm is one normally used with a shovel and a backhoe, the invention may further be deemed to include means for mounting the shovel to the platform to permit movement of the same during splitting of the wood. Such means may include a wedge placed between one end of the shovel and the platform and a bracket for confining the other end of the shovel to the arm holding the shovel.

It may be seen that a novel and useful device has been described which is able to split wood which may use the components of an existing backhoe.

It is therefore an object of the present invention to provide a device for splitting wood which uses an existing piece of machinery in conjunction with easily assembled accessories to split logs into one or more pieces.

It is another object of the present invention to provide a device for splitting wood which is more powerful and requires less maintenance during the splitting of a large number of logs than existing log splitting machines.

It is yet another object of the present invention to provide a device for splitting wood which is safe and easy to use.

The device of the present invention possesses other objects and advantages, especially as concerns particular chracteristics and features thereof which will become apparent as the specification continues.

For a better understanding of the invention, reference is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

Figure 1:
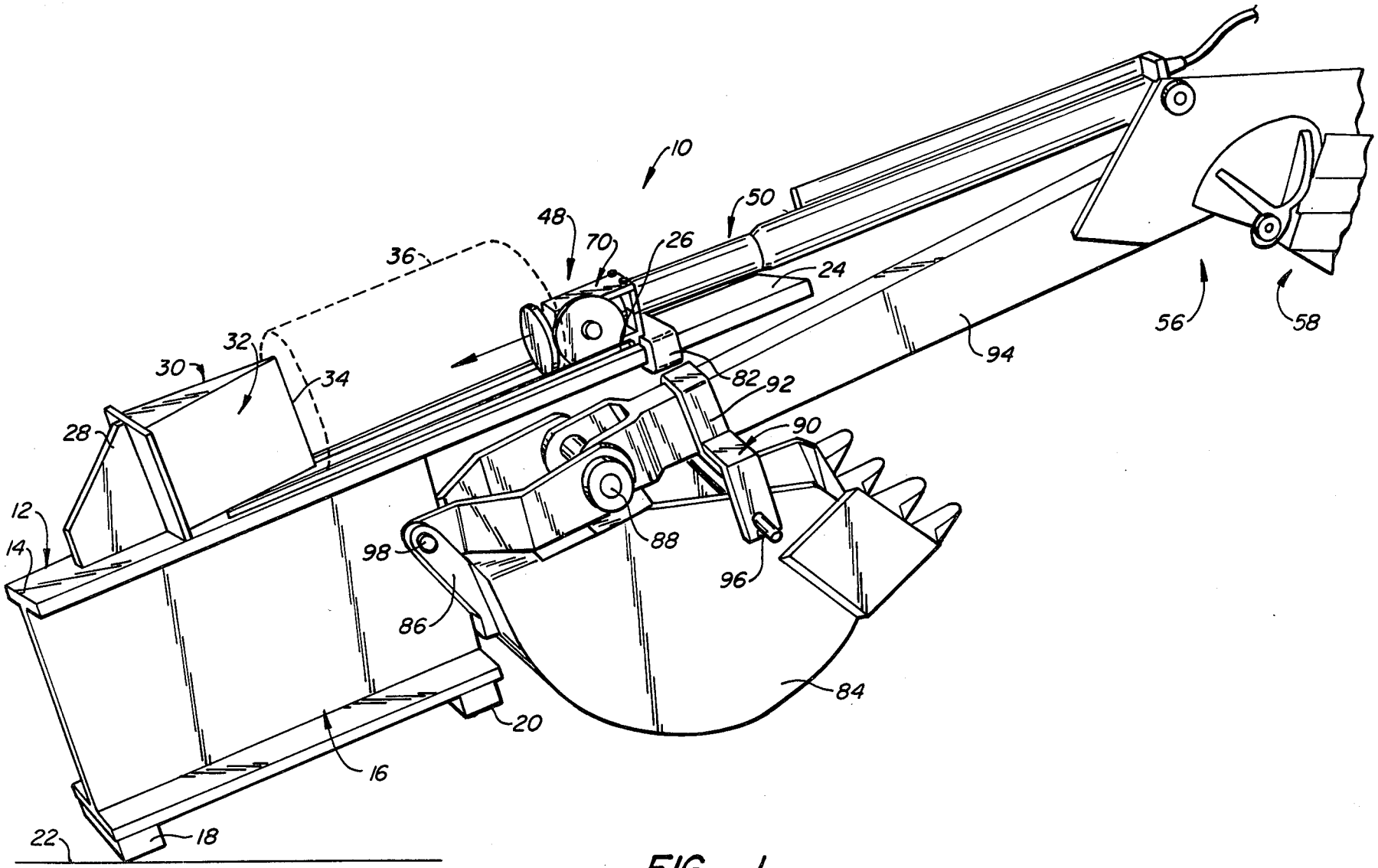
FIG. 1 is a top perspective view of the device of the present invention.

With reference to FIG. 1, the device of the present invention is identified by reference character 10 and includes as one of its elements a platform 12. Platform 12 possesses an upper portion 14 and a base portion 16. Base 16 includes feet 18 and 20. It should be noted that foot 18 is contact with ground surface 22. Upper portion 14 of platform 12 includes a sliding surface 24 and a track 26, FIGS. 1 and 2.

Welded or otherwise affixed to upper portion 14 is a brace 28. A wedge member 30 also affixes to brace 28. Wedge member 30 may embrace a multiplicity of wedges which have been welded together along a plurality of seams 32. Wedge member 30 may be removably fixed to brace 28.

Figure 3A:
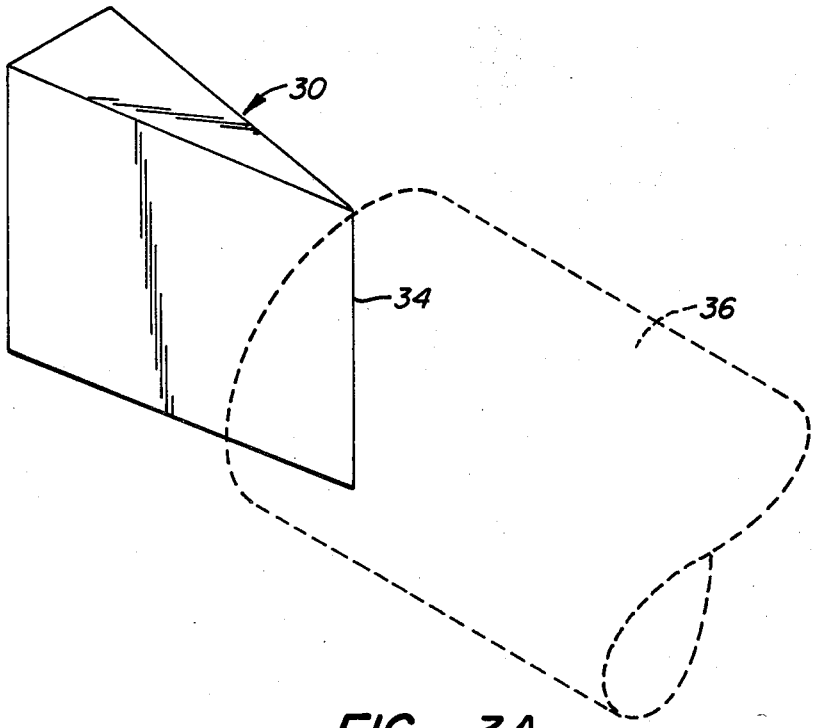
FIG. 3A is a perspective schematic view of the action of embodiment of the wedge of the present invention.
Figure 3B:
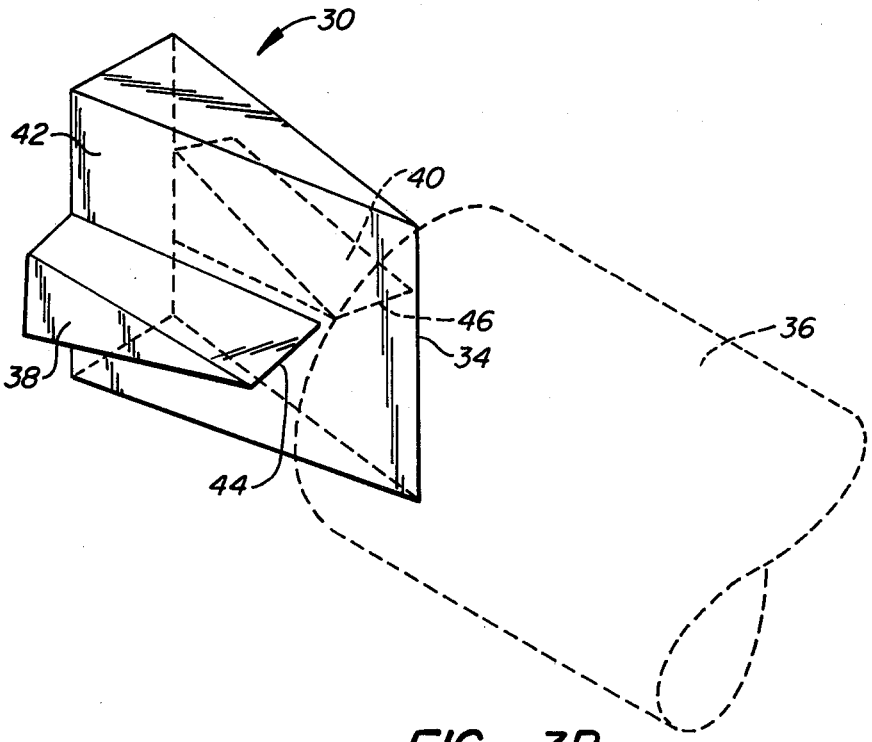
FIG. 3B is a perspective schematic view of another embodiment of the wedge of the present invention.

With reference to FIG. 3A, it may be seen that wedge member 30 may take a conventional configuration, i.e. a triangular cross-sectional configuration. Wedge 30 includes a leading edge 34 which is meant to contact log 36 (shown in phantom on FIGS. 1, 3A, and 3B). Turning to FIG. 3B it may be seen that wedge number 30 may also include wedges 38 and 40 which are attached to a conventional wedge 42. Wedges 38 and 40 include leading edges 44 and 46. It should be noted that edges 44 and 46 are recessed or offset from edge 36 of wedge 42. Thus, log 36 will encounter edge 36 of wedge 42 before edges 44 and 46 of wedges 38 and 40.

Figure 2:
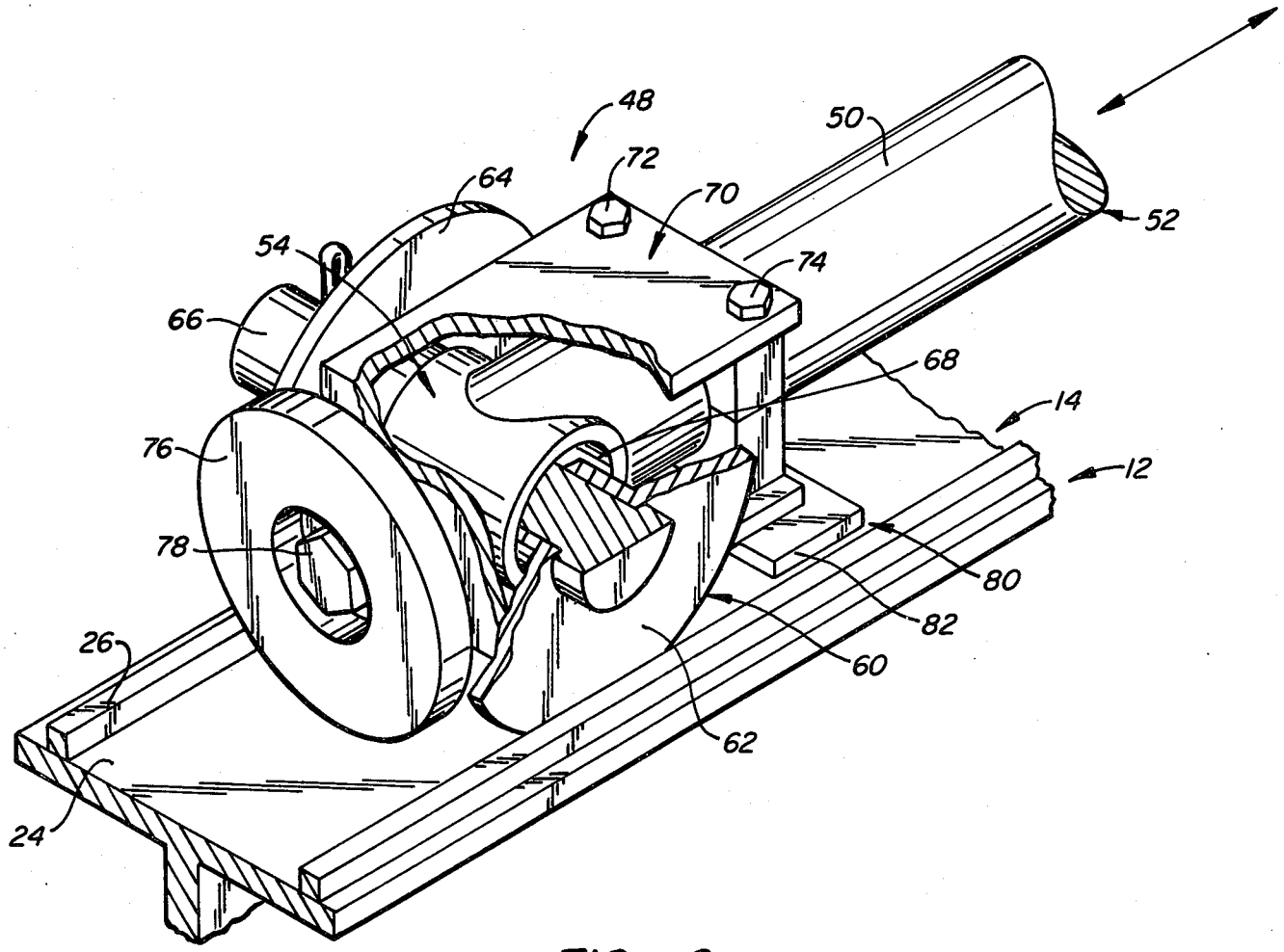
FIG. 2 is a top broken perspective view of a portion of a means for pushing the wood into contact with the wedge of the present invention.

The device of the present invention also embraces means 48 for pushing or forcing the wood 36 into contact with the wedge member 30. With reference to FIG. 2, it may be seen that means 48 includes an arm 50 having a proximal end portion 42 and a distal end portion 54. Distal end portion 54 is intended for contacting the log 36 while proximal end portion 52 is linked to means 56 for extending and contracting arm 50. Means 56 may be the engine and control normally associated with a conventional backhoe 58 which is known in the trade. It should be noted, that the throttle and controls for the means 56 may be extended to a point adjacent means 48 for the sake of convenience. Returning to FIG. 2, it may be seen that track 26 located on platform 12 finds a rotatable member 60 which is guided along upper surface 24 by track 26.

Rotatable member 60 will move along surface 24 during extension and contraction of arm 50. As shown in the drawings, an embodiment of rotatable member 60 may externalize in a pair of wheels 62 and 64 which are rotatably mounted to an axle 66. Arm 50 provides an eye 68 which serves as a bearing for axle 66.

Housing 70 is connected to arm 50 by means of bolt 72 and 74. Affixed to the front portion of housing 70 is a face in the form of a disc 76 which is fastened to housing 70 by means of bolt 78. Means 80 confines rotatable members 60 to platform 12. Means 80 embraces a bracket or strap 82 which slides along upper portion 14 of platform 12, FIGS. 1 and 2.

Returning to FIG. 1, it may be seen that a shovel 84 normally associated with backhoe 58 is held to platform 12 by the use of a spacer 86. Shovel 84 is also restricted from rotation about pivot 88 by the use of a bracket 90. Bracket 90 includes a member 92 which fits over arm 94 and a pin 96 which passes through the side portions of shovel 84. Thus, shovel serves to stabilize platform 12 during the operation of the device of the present invention which will be described hereinafter.

In operation, the user detaches arm 50, and in particular, eye 68 from pin 98 associated with shovel 84. In the meantime, shovel 84 is connected to platform 12 by the use of pin 98. Wedge 86 prevents a degree of movement of shovel 84 in relation to platform 12. Bracket 90 holds shovel 84 to shovel arm 94 by the use of pin 96. Eye 68 of arm 50 is then employed to encircle axle 60 and the rotatable member 60 associated therewith. Means 48 for forcing log 36 into contact with wedge 30 is then connected to arm 50 thereby. The actuation of means 56 for extending and contracting arm 50 in the extension mode will force log 36 against edge 34 of wedge 30 and split log 36. During this operation, face 76 actually contacts and end of log 36 and rotatable member 60 rides along the upper surface 24 of platform 12 within track 26. Reversal of arm 50 into the contraction mode will permit means 48 to ready for a repeat operation with another log. Means 80 retains means 48 to platform 12 during this operation. As heretofore described, a remote control for means 56 may be used by an operator immediately adjacent means 48. After log splitting, the backhoe 58 may be reassembled and function in its normal capacity.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed:

1. A device for converting a ground supported and machine operated shovel to a wood splitter, the machine operated shovel having a connected shovel arm and a detachable extending and contracting arm, comprising:

a. a platform for supporting wood, said platform having means thereon positioned to contact the ground;

b. a wedge being fixed to said platform;

c. means for forcing the wood into contact with said wedge along said platform said means for forcing the wood into contact with said wedge including the extending and contracting arm detached from the shovel, the extending and contracting arm having a proximal and distal end portion, said distal end portion contacting the wood, said proximal end portion of said extending and contracting arm being linked to means for extending and contracting said extending and contracting arm; and d. means for holding the shovel detached from the extending and contracting arm to said ground contacting platform, the shovel and connected support arm being connected to said means for extending and contracting the extending and contracting arm.

2. The device of claim 1 in which said means for forcing the wood into contact with the said wedge further includes a track located on said platform cooperating with a rotatable member located between said proximal and distal end portions of said extending and retracting arm, said rotatable member being movable in said track during said extension and contraction of said arm.

3. The device of claim 2 which further comprises means for confining said rotatable member to said track.

4. The device of claim 3 in which said wedge includes a first edge for contacting the wood in one direction and a second edge for contacting the wood in another direction.

5. The device of claim 4 in which said edge is a leading edge in contacting the wood and said second edge is recessed in relation to said leading edge.

6. The device of claim 5 in which said rotatable member includes a pair of wheels rotatable mounted to an axle, said arm including an eye for holding said axle during extension and retraction of said arm.

7. The device of claim 6 in which said means for confining said rotatable member to said track further includes a bracket connected to said arm and slidingly engaging said platform.

8. The device of claim 7 in which said means for forcing the wood into contact with said wedge further includes a face connected to said arm between said rotatable member and said wedge along said platform.

9. The device of claim 1 in which said means for forcing the wood into contact with said wedge further comprises means for restricting movement of the shovel in relation to the connected shovel arm.

* * * * *